US010944173B2

(12) United States Patent
Johansson et al.

(10) Patent No.: US 10,944,173 B2
(45) Date of Patent: Mar. 9, 2021

(54) ANTENNA ARRAY AND ARRANGEMENT COMPRISING AN ANTENNA ARRAY AND A NETWORK NODE

(71) Applicant: Telefonaktiebolaget LM Ericsson (publ), Stockholm (SE)

(72) Inventors: Martin Johansson, Mölndal (SE); Fredrik Athley, Kullavik (SE); Andreas Nilsson, Gothenburg (SE); Sven Petersson, Sävedalen (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 262 days.

(21) Appl. No.: 16/323,558

(22) PCT Filed: Sep. 8, 2016

(86) PCT No.: PCT/EP2016/071185

§ 371 (c)(1),
(2) Date: Feb. 6, 2019

(87) PCT Pub. No.: WO2018/046086

PCT Pub. Date: Mar. 15, 2018

(65) Prior Publication Data

US 2019/0173177 A1 Jun. 6, 2019

(51) Int. Cl.
*H01Q 5/40* (2015.01)
*H01Q 5/42* (2015.01)
(Continued)

(52) U.S. Cl.
CPC ..... *H01Q 5/42* (2015.01); *H01Q 1/246* (2013.01); *H01Q 5/40* (2015.01); *H01Q 21/08* (2013.01); *H01Q 21/26* (2013.01)

(58) Field of Classification Search
None
See application file for complete search history.

(56) References Cited

U.S. PATENT DOCUMENTS 6,211,841 B1 * 4/2001 Smith ..... H01Q 1/246 343/797
8,823,598 B2 9/2014 Beausang et al.
(Continued)

FOREIGN PATENT DOCUMENTS

CN 1507673 A 6/2004
CN 1926901 A 3/2007
(Continued)

OTHER PUBLICATIONS

International Search Report and Written Opinion of the International Searching Authority, PCT/EP2016/071185, dated Jun. 1, 2017, 8 pages.
(Continued)

*Primary Examiner* — Andrea Lindgren Baltzell
*Assistant Examiner* — Jianzi Chen
(74) *Attorney, Agent, or Firm* — Sage Patent Group

(57) ABSTRACT

An antenna array comprising at least two sets of antenna unit elements is disclosed. Each set of antenna unit elements supports a respective frequency band, wherein a vertical center-to-center distance between the antenna unit elements of a lowest frequency among the respective frequency bands is more than twice the vertical extension, D, of convex hull containing one antenna unit element of the lowest frequency, and antenna unit elements of at least a second set are arranged interleaved with the antenna unit elements of the lowest frequency. An arrangement comprising the antenna array and a network node is also disclosed.

12 Claims, 4 Drawing Sheets

(51) Int. Cl.

| | |
|---|---|
| ***H01Q 1/24*** | (2006.01) |
| ***H01Q 21/08*** | (2006.01) |
| ***H01Q 21/26*** | (2006.01) |

(56) References Cited

U.S. PATENT DOCUMENTS

| | | | | |
|---|---|---|---|---|
| 2004/0145526 | A1 | 7/2004 | Baliarda et al. | |
| 2005/0147060 | A1 | 7/2005 | Buckley | |
| 2008/0273549 | A1 | 11/2008 | Orfanos et al. | |
| 2009/0135078 | A1* | 5/2009 | Lindmark | H01Q 21/08 343/844 |
| 2012/0280881 | A1 | 11/2012 | Beausang | |
| 2013/0155991 | A1 | 6/2013 | Ali et al. | |
| 2014/0062834 | A1 | 3/2014 | Judhage et al. | |
| 2014/0242930 | A1 | 8/2014 | Barker et al. | |
| 2014/0368395 | A1 | 12/2014 | Dauguet et al. | |
| 2015/0249531 | A1 | 9/2015 | Lindoff et al. | |
| 2019/0173177 | A1* | 6/2019 | Johansson | H01Q 5/42 |

FOREIGN PATENT DOCUMENTS

| | | | |
|---|---|---|---|
| CN | 101048975 | A | 10/2007 |
| CN | 101228665 | A | 7/2008 |
| CN | 102832455 | A | 12/2012 |
| CN | 103168491 | A | 6/2013 |
| CN | 104067442 | A | 9/2014 |
| CN | 104662939 | A | 5/2015 |
| CN | 104685708 | A | 6/2015 |
| CN | 205069883 | U | 3/2016 |
| WO | WO 2015 /133458 | A1 | 9/2015 |

OTHER PUBLICATIONS

Chinese Office Action for Chinese Application No. 2016800890161 dated Jul. 1, 2020, 9 pages.

English Translation of Chinese Search Report for Chinese Application No. 2016800890161 dated Jun. 23, 2020, 3 pages.

* cited by examiner

ANTENNA ARRAY AND ARRANGEMENT COMPRISING AN ANTENNA ARRAY AND A NETWORK NODE

CROSS REFERENCE TO RELATED APPLICATIONS

This application is a 35 U.S.C. § 371 national stage application of PCT International Application No. PCT/EP2016/071185 filed on Sep. 8, 2016, the disclosure and content of which is incorporated by reference herein in its entirety.

TECHNICAL FIELD

The technology disclosed herein relates generally to the field of antenna technology and in particular to an antenna array comprising at least two sets of antenna unit elements, each set of antenna unit elements supporting a respective frequency band.

BACKGROUND

There is a variety of requirements for the next generation of mobile communications system (5G), which implies that frequency bands at many different carrier frequencies will be needed. For instance, lower frequency bands will be needed in order to achieve sufficient coverage and higher frequency bands will be needed to reach the required capacity. Mobile communications operators will thus need to deploy a wireless system over a large span of frequencies.

An antenna is typically designed in view of the prerequisites for the particular frequency band in question. Integrating multiple frequency bands into a single antenna aperture will therefore lead to compromises with respect to radiation pattern performance. One solution is to stack higher frequency elements on top of lower frequency elements over a common reflecting ground plane. However, this will make the antenna deeper and the interaction between the elements for the two bands is non-trivial, especially for applications such as beamsteering.

From the above it is realized that in order to maintain a good radiation pattern performance even for the required large span of frequencies, future antenna products will likely need multiple single frequency band antenna solutions. However, this would increase the total size of the base station antennas and is a major concern for the operators. The size of the base station antennas should be kept as small as possible for ease of installation, visual footprint and wind load. Further, site rental cost for the operator is typically related to the physical size of the antenna.

SUMMARY

An objective of the present disclosure is to provide an antenna array supporting multiple frequency bands. A particular objective is to provide an antenna solution supporting multiple frequency bands while also keeping down the antenna size. This objective and others are achieved by the antenna array and arrangement according to the appended independent claims, and by the embodiments according to the dependent claims.

The objective is according to an aspect achieved by an antenna array comprising at least two sets of antenna unit elements, each set of antenna unit elements supporting a respective frequency band. In the antenna array, a vertical center-to-center distance between the antenna unit elements of a lowest frequency (wherein an antenna unit element of a lowest frequency is a single radiating element) among the respective frequency bands is more than twice the vertical extension, D, of the convex hull containing one antenna unit element of the lowest frequency, and antenna unit elements of at least a second set are arranged interleaved with the antenna unit elements of the lowest frequency.

The array antenna provides a number of advantages. For instance, the antenna array has a reduced antenna visual footprint compared to a multiple frequency antenna based on today's practice, which would result in multiple single frequency band antennas. Further, the antenna array disclosed in various embodiments herein, has low wind load and low site rental costs without sacrificing performance. Further still, the number of elements and corresponding components, such as e.g. radios and/or analog phase shifters, can be kept down which will lower the manufacturing costs.

The objective is according to an aspect achieved by an arrangement comprising an antenna array as above and a network node configured to support at least two frequency bands and to use the antenna array for communication with one or more communication devices.

Further features and advantages of the embodiments of the present teachings will become clear upon reading the following description and the accompanying drawings.

DETAILED DESCRIPTION

Figure 1:
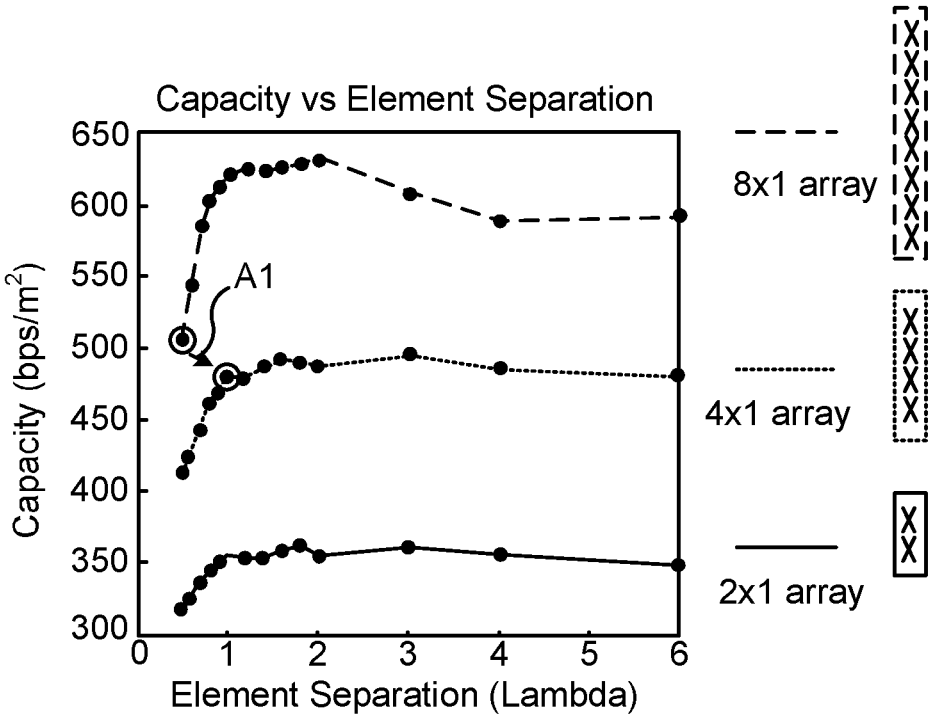
FIG. 1 is a graph showing capacity for different element separations for a vertical single column array with 2, 4 and 8 elements, respectively.

In the following description, for purposes of explanation and not limitation, specific details are set forth such as particular architectures, interfaces, techniques, etc. in order to provide a thorough understanding. In other instances, detailed descriptions of well-known devices, circuits, and methods are omitted so as not to obscure the description with unnecessary detail. Same reference numerals refer to same or similar elements throughout the description.

It is initially noted that the term "antenna unit element" is defined to mean an arrangement of one or more radiating elements located at a "position" of an antenna array, for all frequencies supported by the antenna except the lowest frequency. For the lowest frequency, antenna unit element is defined to mean a single radiating element.

Figure 2A:
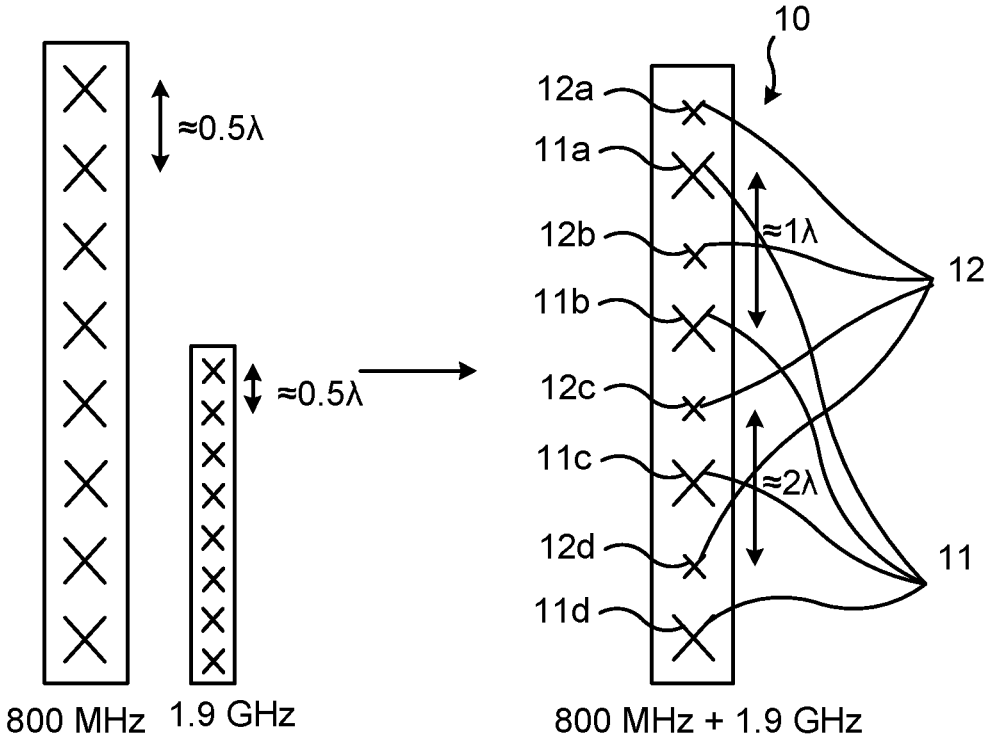
FIG. 2*a* illustrates an antenna array according to a first embodiment according to the present teachings.

For instance, the antenna array 10 of FIG. 2*a* is shown to have eight (8) positions, wherein each position comprises a dual-polarized antenna unit element (which in turn comprises two dual-polarized radiating elements for a higher frequency and a single dual-polarized radiating element for the lowest frequency). The radiating element may, for instance, comprise a metallic conductor.

Further, antenna unit elements illustrated in the figures are drawn as crosses, and it is noted that the size of these are used merely to indicate the relative wavelength, which is not shown to scale, of the respective crosses (antenna unit elements). Hence, a larger cross corresponds to a lower frequency (longer wavelength), while a smaller cross corresponds to a higher frequency (shorter wavelength).

Briefly, various embodiments of an array antenna with interleaved sets of antenna unit elements are described herein addressing and meeting the needs of future mobile communications systems. Each set of antenna unit elements of the array antenna supports a specific frequency band, wherein at least one of the sets has an antenna unit element separation in the vertical dimension that is larger than one wavelength of the corresponding frequency band, and specifically the antenna unit element for the lowest frequency, for which the antenna unit element comprises a single radiating element. In some embodiments, an antenna array with interleaved sets of antenna unit elements is provided, wherein each set of antenna unit elements supports a specific frequency band and wherein for at least one of the sets the following is true: the antenna unit element separation in the vertical extension of the array is more than 2.5 times the vertical extension of the antenna unit element in that set.

Antennas designed for beamforming over large angular intervals are conventionally designed with small antenna radiating element separation, typically in the order of 0.5 wavelengths, in order to avoid grating lobes. In contrast, and in accordance with the present teachings, the antenna unit element separation is larger than the conventional antenna radiating element separation. Thus, for a fixed antenna aperture size, the number of antenna unit elements according to the present teachings is reduced, at the cost of only a minor loss in performance as described below. The increased antenna unit element separation is taken advantage of and used for arranging antenna unit elements for different frequency bands in an interleaved manner.

FIG. 1 is a graph showing downlink capacity for different element separations for a vertical single column array with 2, 4 and 8 antenna unit elements, respectively (the arrays shown at the rightmost part of the figure). The inventors of the present invention have performed simulations in order to investigate gains with elevation (vertical) user equipment (UE)-specific beamforming. The simulations showed that the antenna unit element separation has a large impact on the system performance, and FIG. 1 illustrates how the downlink capacity (y-axis) depends on the antenna unit element separation (x-axis) for a vertical column array. The simulations were performed in a simulator for a flat urban scenario. In the simulations cell reference signals (CRSs) were transmitted on the antenna element patterns, which are used to define the cell coverage. As can be seen in FIG. 1, relatively large antenna unit element separations (1-2λ) give much better performance than an antenna unit element separation of around 0.5λ for a fixed number of array antenna unit elements. The latter antenna unit element separation is, as mentioned earlier, conventionally used in antenna arrays intended for UE-specific beamforming. For example, when going from an eight antenna unit element array (8×1 array) with 0.5λ antenna unit element separation to a four antenna unit element array (4×1 array) with 1λ separation (arrow A1 in the FIG. 1) the system capacity only reduced from 505 bps/m$^2$ to 480 bps/m$^2$, which corresponds to a loss of 5%. Based on this, and in accordance with an aspect of the present teachings, every second antenna unit element in the eight antenna unit element array is removed without resulting in any significant loss in performance. The reason that larger antenna unit element separations gives better performance than small antenna unit element separations for elevation UE-specific beamforming is owing to the relation: the larger antenna unit element separation the narrower the UE-specific beam. The narrower UE-specific beam, the less power will interfere with other UEs. However, for the large antenna unit element separations a grating lobe will also occur which will generate interference, but for elevation beamforming this grating lobe typically ends up towards or near zenith or nadir and hence does not generate any or only very limited interference towards other users.

Based on the above simulations and reasoning, an antenna array, in different embodiments, was designed for meeting the demands of the next generation of mobile communications system (5G) by enabling efficient deployment of a large span of frequencies.

In the following embodiments steerable antenna arrays are assumed that can perform UE-specific beamforming, Single User-Multiple Input Multiple Output (SU-MIMO) and/or Multiple User (MU)-MIMO over all antenna unit elements in the array (for respective frequency band). This may be realized by using active antenna arrays with one radio behind each antenna unit element, but it can also be realized with analog beamforming which would require only one radio per polarization or a combination of both.

FIG. 2*a* illustrates an antenna array according to a first embodiment of the present teachings. In the FIG. 2*a*, the first embodiment is shown to the right and a solution based on current practice is shown to the left for comparison. In the solution based on current practice, two separate antenna arrays would be used, one for the respective frequency band, resulting e.g. in the undesired larger footprint.

For embodiments according to the present teachings, half of the antenna unit elements have been removed for each antenna array and the remaining antenna unit elements have been placed on one single aperture. The antenna unit elements are, for this particular embodiment, placed such that for the low frequency band (800 MHz) the antenna unit element separation is 1λ and for the high frequency band (1.9 GHz) the antenna unit element separation is larger than 2λ. The antenna array 10 according to this exemplary embodiment thus comprises two sets of antenna unit elements: a first set 11 for the low frequency band comprising four dual-polarized (in particular cross-polarized) radiating elements 11*a*, 11*b*, 11*c*, 11*d* and a second set 12 for the high frequency band comprising four dual-polarized antenna unit elements 12*a*, 12*b*, 12*c*, 12*d*.

Figure 2B:
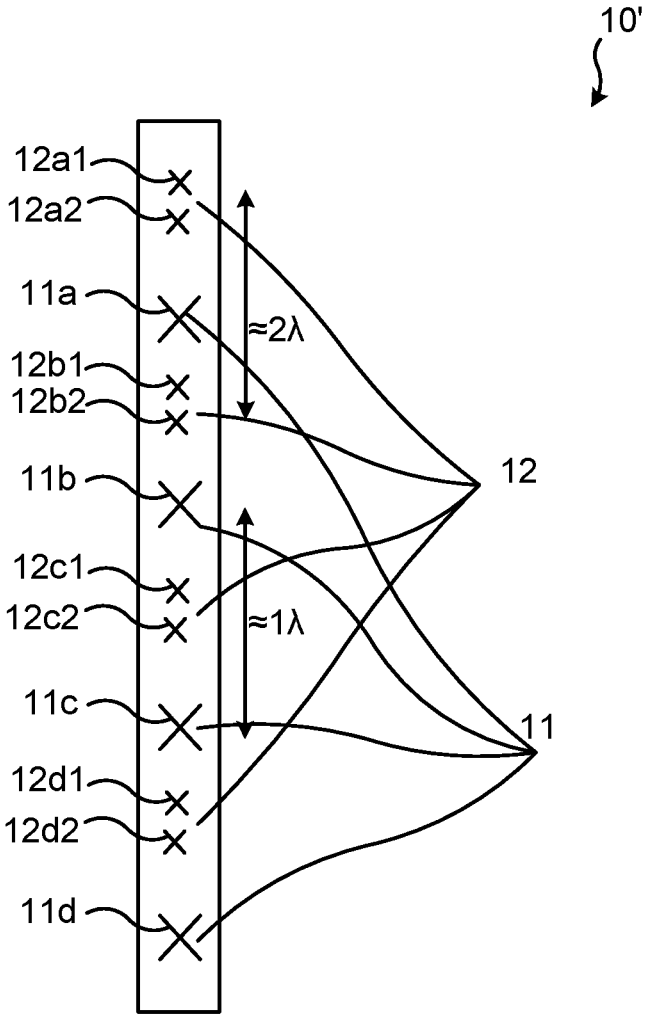
FIG. 2*b* illustrates a variation of the antenna array according shown in FIG. 2*a*.

FIG. 2*b* illustrates a variation of the antenna array according shown in FIG. 2*a*. In particular, for the higher frequency (i.e. 1.9 GHz in the illustrated case) there are two antenna unit elements 12*a*1, 12*a*2; 12*b*1, 12*b*2; 12*c*1, 12*c*2; 12*d*1, 12*d*2 "per position", i.e. interleaved between the radiating elements 11*a*, 11*b*, 11*c*, 11*d* of the lower frequency (800 MHz in the illustrated case). The antenna array 10' of FIG. 2*b* thus also to has eight (8) positions, wherein half of the positions comprise a dual-polarized radiating element 11*a*, 11*b*, 11*c*, 11*d* and the other half of positions comprise two vertically stacked dual-polarized antenna unit elements 12*a*1, 12*a*2, 12*b*1, 12*b*2, 12*c*1, 12*c*2, 12*d*1, 12*d*2.

Figure 3:
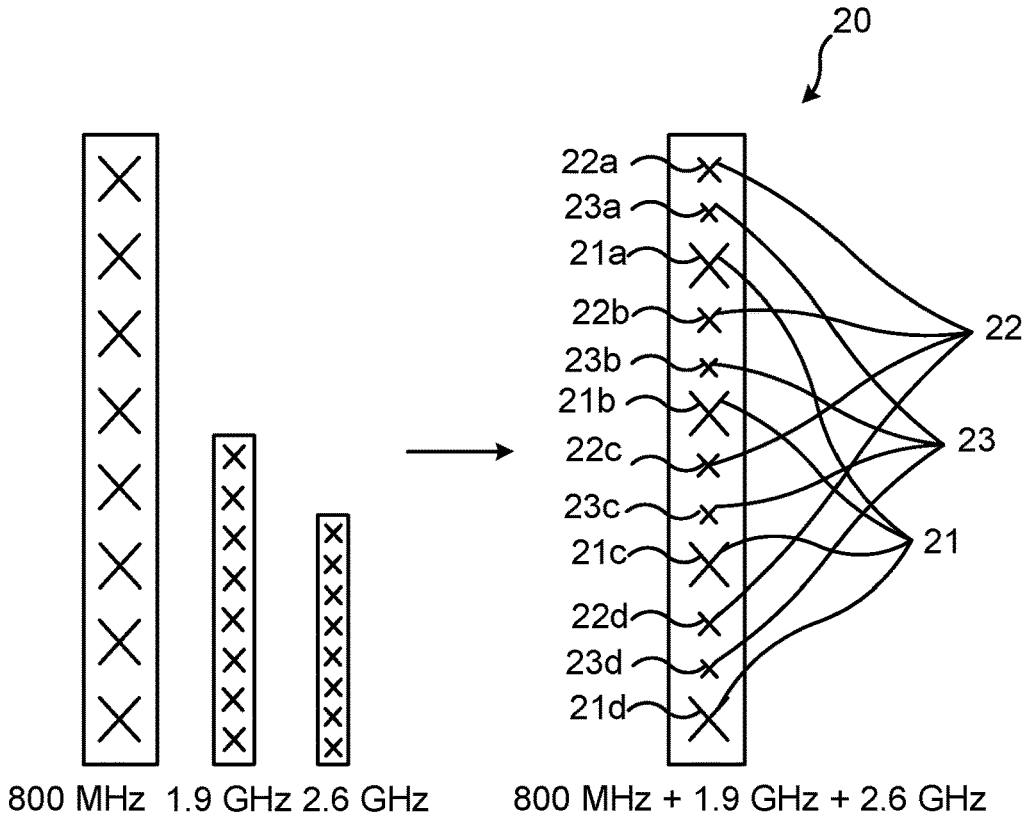
FIG. 3 illustrates an antenna array according to a second embodiment of the present teachings.

FIG. 3 illustrates an antenna array according to a second embodiment of the present teachings. In line with the above figure, the solution based on current practice would use three separate antenna arrays for meeting demands of next generation of mobile communications (shown at the left-hand side). According to the present teachings, the number of antenna unit elements for each frequency band is reduced compared to the solution based on current practice. In the embodiment shown in FIG. 3 hence, three antenna apertures, one per frequency band, have been combined into one single aperture.

Assuming, for example, that the antenna unit element separation (i.e. distance between two positions of antenna unit elements of the same frequency band) for the antenna unit elements of the first frequency band (800 MHz) is $\lambda_{800}/2$ (antenna array at the leftmost part of FIG. 3). According to the present teachings the antenna unit element separation for this first frequency band (antenna array at the rightmost part of FIG. 3) is instead approximately $d=1\lambda_{800}$. For the second frequency band (1.9 GHz) of the shown embodiment according to present teachings, the antenna unit element separation is $d=2.4\lambda_{1800}$ and for a third frequency band (2.6 GHz) the antenna unit element separation is $d=3.25\lambda_{2600}$. The antenna array 20 according to this exemplary embodiment thus comprises three sets of antenna unit elements: a first set 21 comprising four dual-polarized radiating elements 21*a*, 21*b*, 21*c*, 21*d* for the first frequency band, a second set 22 comprising four dual-polarized antenna unit elements 22*a*, 22*b*, 22*c*, 22*d* for the second frequency band and a third set 23 comprising four dual-polarized antenna unit elements 23*a*, 23*b*, 23*c*, 23*d* for the third frequency band.

Figure 4:
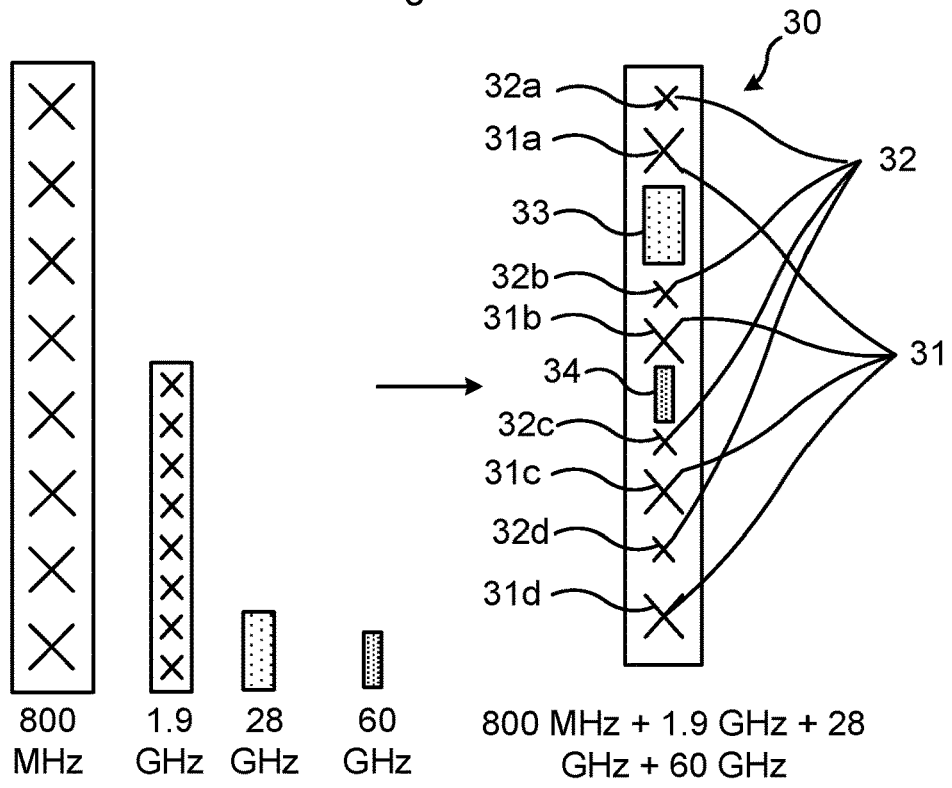
FIG. 4 illustrates an antenna array according to a third embodiment of the present teachings.

As noted earlier, the higher frequencies may have an arrangement of one or more antenna unit elements located at a "position" of the antenna array, in particular one subarray at each of one or more positions. In FIG. 4, described next, the two highest frequencies each comprise a subarray at one respective position.

FIG. 4 illustrates an antenna array according to a third embodiment of the present teachings. In this embodiment, four different antenna apertures, one per frequency band have been combined into one single aperture. For the very high frequencies, 28 GHz and 60 GHz, the whole corresponding antenna arrays have each been placed as contiguous group of radiating elements.

The antenna array 30 according to this exemplary embodiment comprises four sets of antenna unit elements: a first set 31 comprising four dual-polarized radiating elements 31*a*, 31*b*, 31*c*, 31*d* for the first frequency band, a second set 32 comprising four dual-polarized antenna unit elements 32*a*, 32*b*, 23*c*, 32*d* for the second frequency band. For the third frequency band (28 GHz) a third set 33 of antenna unit elements comprising dual-polarized (e.g. cross-polarized) radiating elements, is provided. The third set 33 of antenna unit elements may be densely spaced (a dense array), i.e. all antenna unit elements of the third frequency band are located gathered at a single place. Likewise, for the fourth frequency band (60 GHz) a fourth set 34 of antenna unit elements is provided. In the fourth set 34, the antenna unit elements may be densely spaced (a dense array), i.e. the whole antenna array 34 (all antenna unit elements thereof) for the fourth frequency band is also located at a single place. It is noted that the antenna arrays 33, 34 for the third and fourth frequency bands should preferably be located in a way that allows equidistant antenna unit element placement at first and second frequency bands.

All the illustrated and described embodiments give reduced physical antenna size compared to the solution based on current practice. The reduced physical antenna size will reduce the visual footprint, wind load and site rental cost. Further, fewer antenna unit elements and corresponding beamforming devices (e.g. radios and/or analog phase shifters) are required which will reduce the manufacturing costs.

By using dual-polarization beamforming (DBPF) any potential common signals, such as for example CRS in Long Term Evolution (LTE) or system access signals in next generation air interface (NR), may be transmitted by all antenna unit elements per frequency band while still maintaining the radiation pattern of a single antenna unit element. In this way all the power amplifiers may be utilized and hence the common signals will not be affected by any transmission power loss. For LTE it has been shown in a study that it is preferable to match the cell coverage with the envelope of the UE-specific beams, hence it may be preferred to use the element pattern for CRS signals for this kind of arrays capable of UE-specific beamforming.

Figure 5:
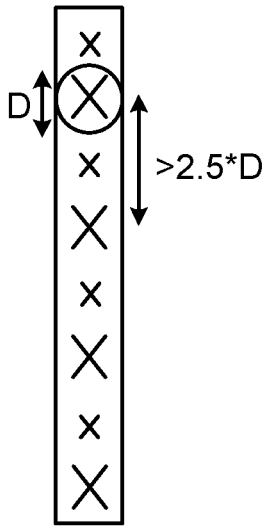
FIG. 5 illustrates a design aspect of embodiment according to the present teachings.

FIG. 5 illustrates a design aspect of embodiment according to the present teachings. The antenna array 10, 20, 30 with interleaved sets of elements is designed with a larger element separation (i.e. distance between antenna unit elements within the respective sets) than the element separation conventionally used. For each set of antenna unit elements, wherein each set supports a specific frequency band, the element separation in the vertical extension of the antenna array 10, 20, 30 is more than twice, e.g. 2.5, times the vertical extension D of the antenna unit element in that set. The vertical extension D of the antenna unit element may be defined as the vertical extension of the convex hull containing one of the antenna unit elements of the set.

As has been described, the antenna array 10, 20, 30 may be an "active" antenna array with multiple sets of antenna unit elements, where the antenna unit elements in each set are tuned to a specific frequency band. The antenna unit element may be a pair of dual-polarized radiating elements or a group of dual-polarized radiating elements fed by a feed network. The vertical center-to-center distance between the antenna unit elements, i.e. between the radiating elements, in the set tuned for the lowest frequency band is preferably at least 2.5D, where D—as an alternative way of defining it—is the diameter of the smallest circle enclosing an antenna unit element, i.e. a radiating element, in the set. The one or more set(s) of antenna unit elements tuned to higher frequency bands are placed in between the antenna unit elements of the lowest frequency band. The set of antenna unit elements tuned for the lowest frequency exhibit a rotational symmetry to allow for beamforming using both of two orthogonal polarizations.

Figure 6:
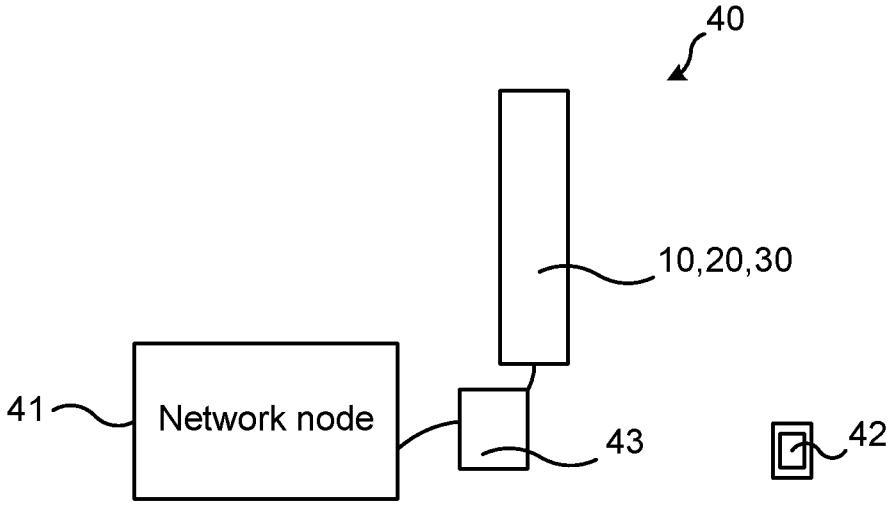
FIG. 6 illustrates schematically an arrangement comprising a network node and antenna array in accordance with the present teachings.

FIG. 6 illustrates schematically an arrangement comprising a network node and antenna array in accordance with the present teachings. Based on the described principles and the various embodiments already described, a number of additional embodiments of the antenna array can be implemented, and some more examples are given in the following.

The antenna array 10, 20, 30 comprises at least two sets 11, 12, 21, 22, 23, 31, 32, 33, 34 of antenna unit elements, wherein each set 11, 12, 21, 22, 23, 31, 32, 33, 34 of antenna unit elements supports a respective frequency band. The antenna array 10, 20, 30 may be a vertical column array. The antenna array 10, 20, 30 may be fed by an antenna feed network 43. The antenna feed network may comprise components such as components for converting radio frequency currents to radio waves and vice versa, power amplifiers, antenna tuner, impedance matching sections etc.

In an aspect, an antenna device is provided comprising the antenna array 10, 20, 30 and the antenna feed network 43.

A vertical center-to-center distance between the antenna unit elements of a lowest frequency among the respective frequency bands is, as described e.g. with reference to FIG. 5, more than twice the vertical extension D of the convex hull containing one antenna unit element of the lowest frequency, wherein the antenna unit element for the lowest frequency is a single radiating element.

The antenna unit elements of at least a second set are arranged interleaved with the antenna unit elements of the lowest frequency. Each antenna unit element of the at least second set comprises an arrangement of one or more radiating elements.

The antenna unit elements of the antenna array 10, 20, 30 are arranged over a ground plane (not shown) that influences the radiation pattern beam width and azimuth angle. As mentioned earlier, the antenna array 10, 20, 30 may be implemented as an active antenna array, having one radio per antenna unit element.

In an embodiment, the vertical center-to-center distance between the antenna unit elements, i.e., radiating elements, of the lowest frequency among the respective frequency bands is 2.5 times the vertical extension D of the convex hull containing an antenna unit element, i.e., radiating element, of the lowest frequency. In other embodiments, the vertical center-to-center distance is 2.1, 2.2, 2.3, 2.4 or more than 2.5 times the vertical extension D of the convex hull containing one antenna unit element of one set of antenna unit elements.

In various embodiments, the antenna array 10, 20, 30 comprises a single antenna aperture.

In a variation of the above embodiment, the antenna unit elements of each of the at least two sets 11, 12, 21, 22, 23, 31, 32, 33, 34 of antenna unit elements are arranged in the single antenna aperture. That is, the aperture of the antenna array 10, 20, 30 is shared by all sets of antenna unit elements (wherein at least the antenna unit elements of the lowest frequency each comprise a single radiating element).

In various embodiments, the antenna array 10, 20, 30 comprises three sets 11, 12, 21, 22, 23, 31, 32, 33, 34 of antenna unit elements, wherein the antenna unit elements of the three sets 11, 12, 21, 22, 23, 31, 32, 33, 34 are arranged interleaved such that every third antenna unit element in the antenna aperture is from the respective sets.

In various embodiments, the antenna array 10, 20, 30 comprises four sets 11, 12, 21, 22, 23, 31, 32, 33, 34 of antenna unit elements, wherein the antenna unit elements of the four sets 11, 12, 21, 22, 23, 31, 32, 33, 34 are arranged interleaved such that every fourth antenna unit element in the antenna aperture is from the respective sets.

In various embodiments, the antenna array 10, 20, 30 comprises n sets of antenna unit elements, wherein the antenna unit elements of the n sets are arranged interleaved such that every n:th antenna unit element in the antenna aperture is from the respective sets.

In various embodiments, the antenna array 10, 20, 30 comprises at least one additional set of antenna unit elements, the antenna unit elements of which are arranged gathered together between two antenna unit elements of the remaining sets 11, 12, 21, 22, 23, 31, 32 of antenna unit elements. Such embodiment was described and shown e.g. in relation to FIG. 4.

In various embodiments, the antenna unit elements of the at least two sets 11, 12, 21, 22, 23, 31, 32, 33, 34 of antenna unit elements comprise dual-polarized radiating elements. Such dual-polarized radiating elements provide/receive radiation in two different polarizations such that, owing to the orthogonal polarizations, two separate communication channels may be provided which can be used independently of each other at the same frequency. The dual-polarized radiating elements may comprise two dipoles radiating in a respective polarization. It is noted that the different frequency bands need not have the same polarizations, and that dipoles of the dual-polarized radiating element may be arranged in a cross geometry (as illustrated in e.g. FIGS. 2 and 3) or arranged in some other way provided that they have orthogonal polarizations.

With reference still to FIG. 6, an arrangement 40 is also provided. The arrangement 40 comprises an antenna array 10, 20, 30 as has been described and a network node 41 configured to support at least two frequency bands and to use the antenna array 10, 20, 30 for communication with one or more communication devices 42. The antenna feed network 43, described earlier may also be part of the arrangement 40. The network node 41 may, for instance, be an evolved nodeB arranged for wireless communication with communication devices 42 such as smart phones, laptops, tablets etc. The described antenna array 10, 20, 30 is used in this wireless communication.

The network node 41 of the arrangement 40 may, in some embodiments, be configured to communicate with the one or more communication devices 42 by performing communication device (e.g. UE) specific transmission over all antenna unit elements of the antenna array 10, 20, 30. The network node 41 may be configured to perform elevation UE-specific beamforming transmission of user data over all elements such that grating lobes appear for the lowest frequency band.

The network node 41 of the arrangement 40 may, in some embodiments, be configured to communicate with the one or more communication devices 42 by performing communication device specific transmission over all antenna unit elements of one set of antenna unit elements of the antenna array 10, 20, 30.

The network node 41 of the arrangement 40 may, in some embodiments, be configured to perform non device-specific signaling over all antenna unit elements within a frequency band of the antenna array 10, 20, 30. The network node 41 of the arrangement 40 may be configured to perform cell-specific transmission of common signals (e.g. broadcast signals) e.g. using beamforming per polarization within each set of antenna unit elements or by using dual-polarization beamforming. An advantage with such embodiments is that common signaling, e.g. broadcasting of system information, can be performed with efficient use of distributed power amplifiers.

It is noted that the network node 41 may be configured to perform one or more of the different examples of transmission modes, i.e. be configured to perform one or more of: communication device specific transmission over all antenna unit elements of one or more sets of antenna unit elements and non device-specific signaling, e.g. broadcasting, over all antenna unit elements.

The invention has mainly been described herein with reference to a few embodiments. However, as is appreciated by a person skilled in the art, other embodiments than the particular ones disclosed herein are equally possible within the scope of the invention, as defined by the appended patent claims.

The invention claimed is:

1. An antenna array comprising:

at least two sets of antenna unit elements, each set of antenna unit elements supporting a respective frequency band, wherein, a vertical center-to-center distance between the antenna unit elements of a lowest frequency among the respective frequency bands is more than twice the vertical extension, D, of convex hull containing one antenna unit element of the lowest frequency, and antenna unit elements of at least a second set are arranged interleaved with the antenna unit elements of the lowest frequency.

2. The antenna array as claimed in claim 1, wherein the vertical center-to-center distance between the antenna unit elements of the lowest frequency among the respective frequency bands is 2.5 times the vertical extension, D, of convex hull containing the antenna unit elements of the lowest frequency.

3. The antenna array as claimed in claim 1, comprising a single antenna aperture.

4. The antenna array as claimed in claim 3, wherein the antenna unit elements of each of the at least two sets of antenna unit elements are arranged in the single antenna aperture.

5. The antenna array as claimed in claim 1, wherein the at least two sets comprises three sets of antenna unit elements, wherein the antenna unit elements of the three sets are arranged interleaved such that every third antenna unit element in the antenna aperture is from the respective sets.

6. The antenna array as claimed in claim 1, comprising wherein the at least two sets comprises four sets of antenna unit elements, wherein the antenna unit elements of the four sets are arranged interleaved such that every fourth antenna unit element in the antenna aperture is from the respective sets.

7. The antenna array as claimed in claim 1, comprising:

at least one additional set of antenna unit elements, the antenna unit elements of which are arranged gathered together between two antenna unit elements of the remaining sets of antenna unit elements.

8. The antenna array as claimed in claim 1, wherein the antenna unit elements of the at least two sets of antenna unit elements comprise dual-polarized radiating elements.

9. An arrangement comprising:

an antenna array including, at least two sets of antenna unit elements, each set of antenna unit elements supporting a respective frequency band, wherein, a vertical center-to-center distance between the antenna unit elements of a lowest frequency among the respective frequency bands is more than twice the vertical extension, D, of convex hull containing one antenna unit element of the lowest frequency, and antenna unit elements of at least a second set are arranged interleaved with the antenna unit elements of the lowest frequency; and a network node configured to support at least two frequency bands and to use the antenna array for communication with one or more communication devices.

10. The arrangement as claimed in claim 9, wherein the network node is configured to communicate with the one or more communication devices by performing communication device specific transmission over all antenna unit elements of the antenna array.

11. The arrangement as claimed in claim 9, wherein the network node is configured to communicate with the one or more communication devices by performing communication device specific transmission over all antenna unit elements of one set of antenna unit elements of the antenna array.

12. The arrangement as claimed in claim 9, wherein the network node is configured to perform non device-specific signaling over all antenna unit elements within a frequency band of the antenna array.

* * * * *